United States Patent [19]

Iida

[11] 4,093,166

[45] June 6, 1978

[54] HORIZONTAL POSTURE MAINTENANCE STRUCTURE

[76] Inventor: Shonosuke Iida, 759 Nishikubo, Chigasaki-shi, Kanagawa-ken, Japan

[21] Appl. No.: 806,214

[22] Filed: Jun. 13, 1977

[30] Foreign Application Priority Data

Aug. 21, 1976 Japan ..... 51-111874[U]

[51] Int. Cl.[2] ..... A47C 7/70

[52] U.S. Cl. ..... 248/126; 211/85; 248/138; 248/311.1 R

[58] Field of Search ..... 248/184, 126, 150, 167, 248/137, 138, 311.1, 309, 139, 141, 136; 211/75, 85, 133; 220/85 H

[56] References Cited

U.S. PATENT DOCUMENTS

| | | | |
|---|---|---|---|
| 392,105 | 10/1888 | Chapman | 248/138 |
| 837,415 | 12/1906 | Marriott | 248/184 X |
| 1,112,230 | 9/1914 | Smith | 248/138 |
| 1,305,671 | 6/1919 | Schaub | 248/167 X |
| 2,030,775 | 2/1936 | Twiss | 248/150 X |
| 2,048,608 | 7/1936 | Holland | 248/150 |
| 3,051,428 | 8/1962 | Schult | 220/85 H X |
| 3,184,201 | 5/1965 | Smith | 248/311.1 |
| 3,259,416 | 7/1966 | Mannisi | 220/85 H X |
| 3,604,671 | 9/1971 | Walker | 248/309 |

*Primary Examiner*—J. Franklin Foss
*Attorney, Agent, or Firm*—Frank J. Jordan

[57] ABSTRACT

A new and improved horizontal posture maintenance structure which permits being restored to the original horizontal condition in defiance of inclination at rolling, pitching or swing place and maintaining the original state thereof by righting moment in accordance with gravity of the structure comprising two pairs of similar figure elements which are pivotally fitted at the each end and are rotatably supported at the bottom and also are spread at right angles to each other. A small type of the horizontal posture maintenance structure of the present invention is hung on a wall or is put on a table, and a large type of the structure is removably installed on a floor board. Excellent effect for restoration and maintenance of horizontal posture and condition, such as on rolling, pitching or swing place, is obtained.

7 Claims, 6 Drawing Figures

HORIZONTAL POSTURE MAINTENANCE STRUCTURE

BACKGROUND OF THE INVENTION

This invention relates to horizontal posture maintenance structure and particularly structure used to restore and keep horizontal posture and condition in defiance of any inclination on rolling, pitching or swing place.

This invention relates to horizontal posture maintenance structure which comprises of combination of newly and more simple similar figure elements and which is made more easily with simple manufacturing process and economically at a low price and which also can obtain excellent and fine effect for restoration and maintenance of the original state.

At a time of table service for meal or drinking during travelling by transportation of bus, train, ship or plane, etc., generally speaking, passenger may usually suffer difficulty to maintain stability and equilibrium of tableware or cup on a table because of rock or irregular movement thereof. Though a small table is installed before seat or cockpit, the contents in cup or dish is often shedded by rock, or the tableware moves on the table or drops to the floor, then, clothing or others may be soiled.

Usually, at delivery of dishes for vermicelli or noodle to order, container or cup serving succulent noodle or others are put in a transporter.

It has been proposed a transporter which is swung through spring means from an arm extended on a carrier of a motorbicycle in order to prevent the juicy contents from shedding or scatter in rocking condition during the motorbicycle runs, by means of restoration by pivotally swung transporter. Such well known device could be obtained buffer effect in some measure by buffer equipment of spring against virtical joggle of a motorbicycle, however, it was difficult to maintain always horizontal posture or condition of the container, and it could not prevent the juicy contents from shedding or scatter by inclination of the container in accordance with great rock and sway. Also, during delivery of such juicy contents, i.e. noodle, etc., it could not be save the soup from shedding, since it might not be sufficient to keep horizontal posture of the transporter. And, such well known device is only swung and could not be possible to modify it as a large type device for use of heavy weight matter or large volume container.

Also, when a ship might meet billows or stormy weather, the body of the ship would incline by pitching or rolling on such billows. When such bad condition might continue for a long time, passenger or sailor will usually get seasickness or it will be difficult to ready kitchen work or to have a meal in a cabin by inclination of a kitchen unit and kitchenware or a table on which the tableware moves, scatters or drops from the table by inclination of the ship or any transportation. Moreover, it might be often difficult to proceed watching or getting an astronomical observation on the standing still base during navigating under the bad weather.

SUMMARY OF THE INVENTION

Briefly, the present invention provides a new and improved horizontal posture maintenance structure which keeps automatically the horizontal posture or condition thereof in accordance with righting moment by gravity themselves in defiance of inclination of the wall board or floor.

The horizontal posture maintenance structure of the present invention comprises substantially four similar figure and narrow strip semicircular or "U" shaped elements which are made from aluminium alloy or rigid plastic resins and which compose two pairs of outer and inner members and each pair of the elements is pivotally fitted at the each end thereof and these members are rotatably supported between the inner element of the outer member and the outer element of the inner member. The outer element of the outer member operates as a slinger and other inner element of the same outer member operates as a dangler. The outer element of the inner member operates as a rotator, and other inner element of the same inner member operates as a rocker, too.

The slinger has a stand holder at the rear surface of the bottom thereof, which the holder is used as a stand or hanger on a wall.

The outer and inner members of the structure are spread at a right angler by a axis of the bottom to each other. The dangler can pivotally move against the slinger, and the rocker can pivotally move against the rotator, too. Therefore, against any inclination or shaking, the rocker always restores and keeps horizontal posture itself. A container of juicy contents or any other plate can be settled in the semicircular chamber surrounded by the pairs of outer and inner member.

Accordingly, an object of the present invention is to overcome the aforementioned disadvantages of prior arts and provide an improvement which resides in the novel parts and combination of the elements.

Another object of the present invention is to provide a structure to effect restoration against inclination or shaking and to effect maintenance of horizontal posture and condition thereof.

A further object of the present invention is to provide the device of the foregoing type which is settled at shaking or inclinating place of transportation of bus, ship, train, or plane etc. or to be used as a carriage in a case where rock is expected.

A further object of the present invention is to provide collapsible, handy or stowable device when not wanted.

Other object and many of the attendant advantages of this invention will be readilly appreciated as the same become better understood by reference to the following description.

BRIEF DESCRIPTION OF THE DRAWINGS

The accompanying drawings illustrate the preferred embodiment of the present invention. In the drawings, the same reference numerals illustrate the same parts of the invention, in which.

THE DETAILED DESCRIPTION OF THE INVENTION

Figure 1:
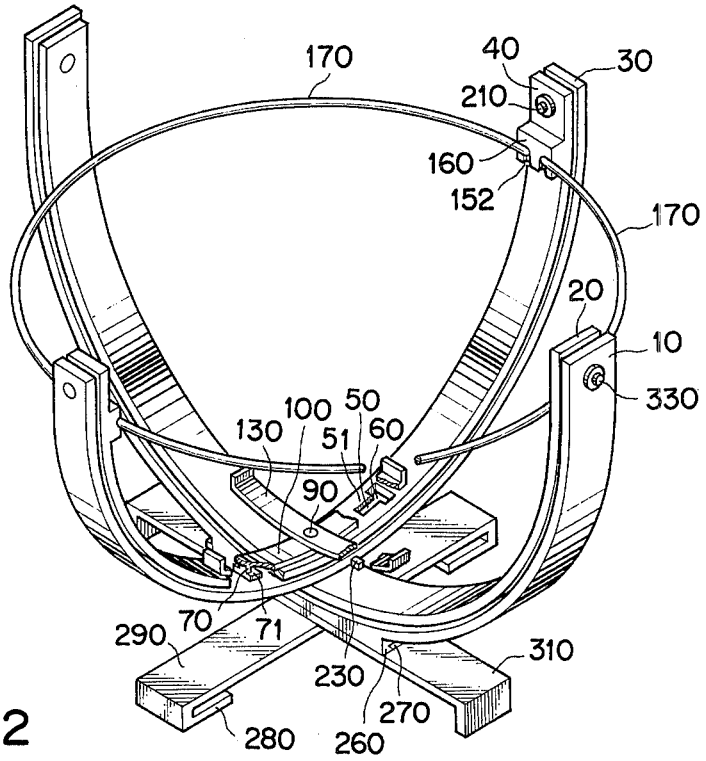
FIG. 1 is a diagrammatic slant illustration of the present invention where the elements are spread to condition of use.
Figure 2:
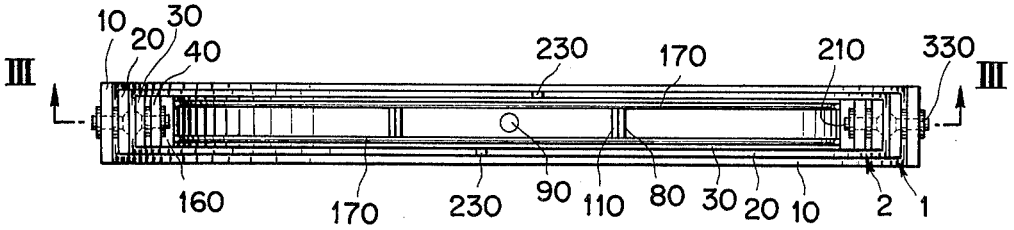
FIG. 2 is a top plane view of the structure when folded.

Referring to the drawings there is shown accordingly to a preferred embodiment of the invention, the horizontal posture maintenance structure of the present invention comprises from general semicircular shaped similar figure main four elements which are a slinger 10, a dangler 20, a rotator 30 and a rocker 40 being made from aluminium alloy or rigid plastic resins, and these elements are formed smaller in similar figure in this order. The later both elements of the rotator 30 and the rocker 40 are same width. With respect to form of the main elements, in this detailed disclosure and on the drawings, it is only explaned the semicircular form as one of the embodiment, but form of these elements can be changed to "U" shaped or other forms where these elements can be pivotaly moved and can be rotated to each other.

A hole 180 for pivot is dug at each end of the longitudinal direction of the rocker 40. Said rocker 40 is excavated a pair of aperture 60 having longitudinal narrow notches 50 at the curved bottom and rear parts of the each side wall 51 along the notches 50 are formed recess corresponding to the width of the aperture 60. And also, a hole 200 for pivot corresponding to said hole 180 is dug by aforesaid same manner at each end of the longitudinal direction of the rotator 30, too. At the center of the bottom of the rotator 30, a hole 190 for axis is dug. The rotator 30 and the rocker 40 are pivoted at the each end by means of pin 210 which is inserted into the both holes 180 and 200 of the both members.

By aforesaid same manner, a hole 240 for pivot is dug at each end of the longitudinal direction of the dangler 20, and a short axis 220 is inwardly projected at the center of the bottom of the dangler 20. At the both side of the axis 220, a pair of the protrusion 230 for limit of rotation of the rotator 30 is provided so as to remain the same width of the rotator 30. And also a hole 320 for pivot corresponding to said hole 240 is dug at each end of the longitudinal direction of the slinger 10. At the rear surface of the bottom of the slinger 10, a slender protrusion 260 is provided on which a dovetail groove 25 is formed. The slinger 10 and the dangler 20 are pivoted at the each end by means of a pin 330 which is inserted to the both holes 240 and 320 of the both members. And also the axis 200 of the dangler 20 is rotatably engaged with the hole 190 of the rotator 30.

Namely, the slinger 10 and the dangler 20 are pivoted by the pin 330 at the both ends of the top portion and constitute a outer member 1. And by the same manner, the rotator 30 and the rocker 40 are pivoted by the pin 210 at the both ends of the top portion and constitute a inner member 2.

Figure 6:
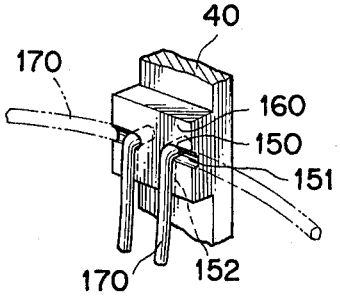
FIG. 6 is a diagrammatic illustration of greatly enlarged detailed view of a part "S" in the FIG. 3 showing a condition of engagement with a pair of the springy protection members.

A lower support 100 which is same width or narrow than the rocker 40 and is curved by the same rate as the rocker has a pair of projected necks 70 being barely narrow width than the width of the notches 50 and has also a pair of protrusion pieces 71 having barely narrow width than the aperture 60 at the top of the both neck 70. The thickness of the protrusion pieces 71 is same size of the depth of the recess formed on the rear surface of the rocker 40 and the height of the projected neck 70 is same of the thickness of the rocker 40. A short axis 90 is formed at the center part of the inner curved surface of the lower support 100, and the both ends of the longitudinal direction thereof are upwardly bent so as to form a pair of tonguelike pieces 80. A upper support 130 which is same size of the lower support 100 is provided, and at the center of the bottom thereof, a hole 120 is dug so as to insert rotatably the center axis 90 of the lower support 100, and the both ends of the longitudinal direction are upwardly bent so as to form a pair of tonguelike pieces 110. As showing in FIG. 6, protrusion 160 is formed on inner surface at barely downward portion of the pivot portion of the each end of the longitudinal direction of rocker 40. In the protrusion 160, a pair of stopper holes 150 is symmetrically drilled, and horizontal slits 151 are formed from the opening 150 to outwardly and other virtical slits 152 are also formed from the same opening 150 to downwardly so as to engage with the "L" shaped end of the protection member 170. The axis 90 of the lower support 100 is inserted in the hole 120 of the upper support 130, and then, the upper support 130 is piled on the lower support 100 so as to engage the upper support 130 within the both tonguelike pieces 80 of the lower support 100. In the case where the lower support 100 which is piled up the upper support 130 is engaged to the rocker 40, a pair of the neck 70 projected downwardly from the rear surface thereof is inserted into the aperture 60 of the rocker 40, and then the lower support is slided to the notch so as to engage the protrusion of the neck 70 to the recess of the rear surface of the rocker 40.

Moreover, the each end of the springy protection members 170 which are generally formed to semicircle is buoyantly engaged in the stopper holes 150 in the protrusion 160 of the upper end of the rocker 40.

Figure 4:
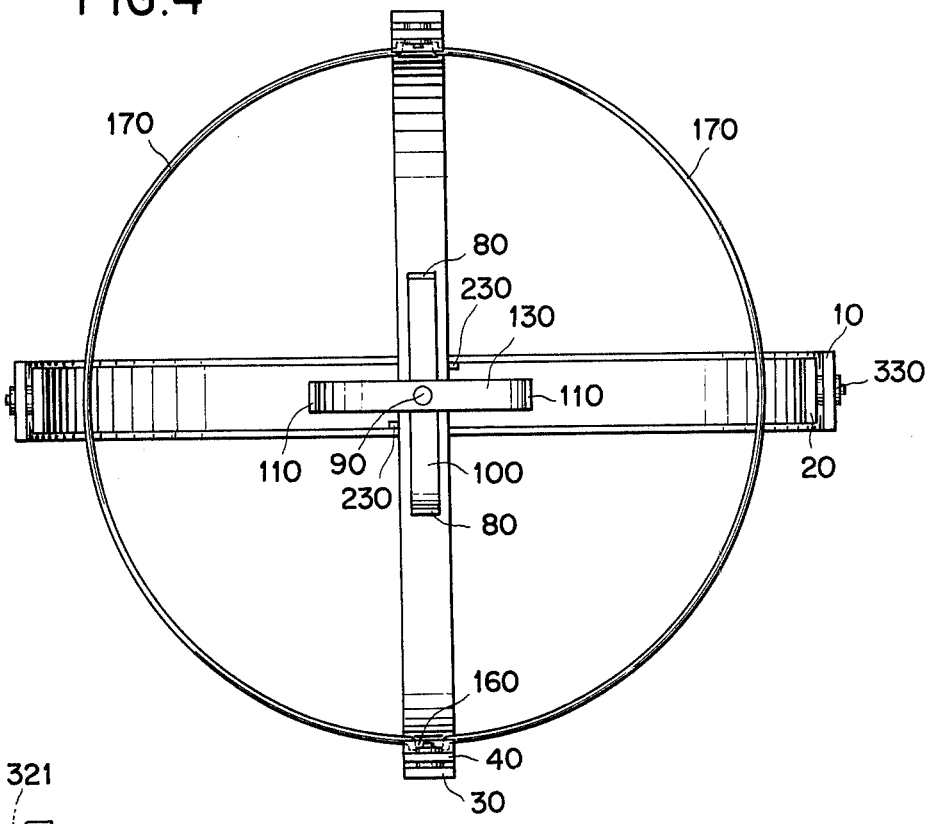
FIG. 4 is a top plane view of the structure when spread.
Figure 5:
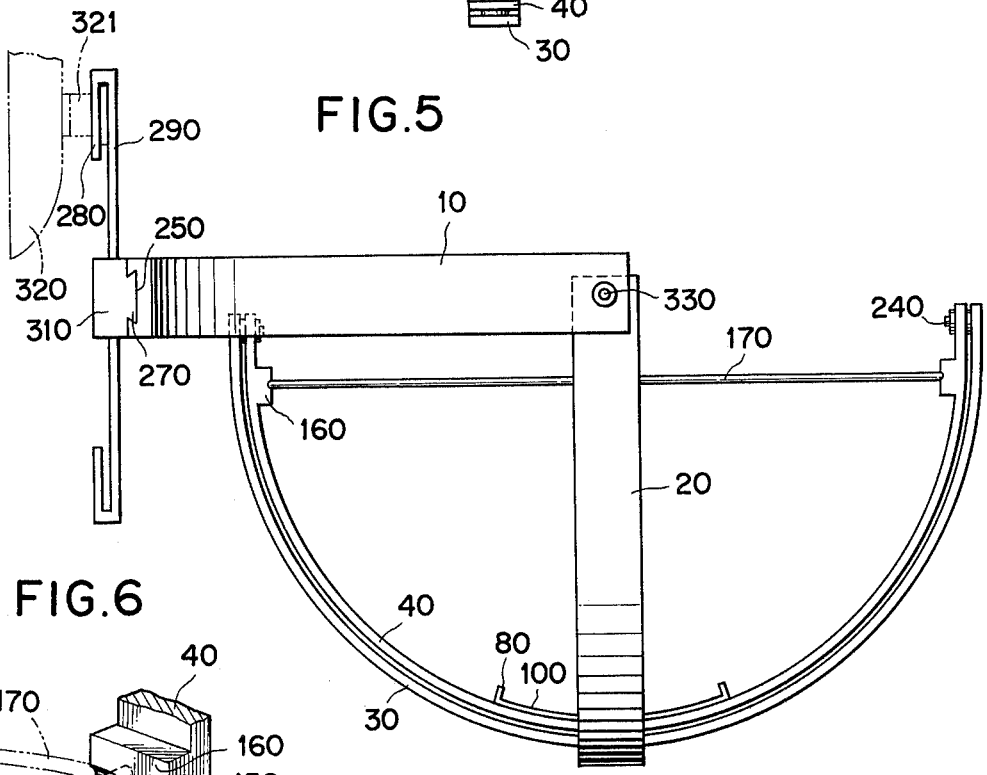
FIG. 5 is a side view of the structure when is spread and is in hanging condition on a wall.

In the case where the springy protection 170 is moved to horizontal direction as shown in FIG. 1 and 5, the bent neck portion of the protection 170 are engaged in the horizontal groove 151 of the protrusion 160 of the rocker 40 as shown in FIG. 4, and a pair of the protection member 170 takes shape of a ring and the both upper ends of the rocker 40 are connected through the ringed protection member 170.

A pedestal 3 of the horizontal posture maintenance structure of the present invention consists of a upper base plate 310 and a lower base plate 290 which are formed to the same width corresponding with the width of aforesaid slinger as one of the embodiment. Various changes and modification in the size, shape and materials as well as in the detailed description of the present illustrated construct can be made without departing from the spirit where the structure of the invention may maintain its stability.

The both ends of longitudinal direction of the upper base plate 310 are downwardly bent, and a dovetail tenon 270 is formed on the upper surface thereof so as to engage with the dovetail groove of the slinger 10 and one of the ends of the dovetail tenon has a projected piece as a stopper (not shown in the drawings). A hole 313 is dug at the center of the rear surface of the upper base plate 310.

Figure 3:
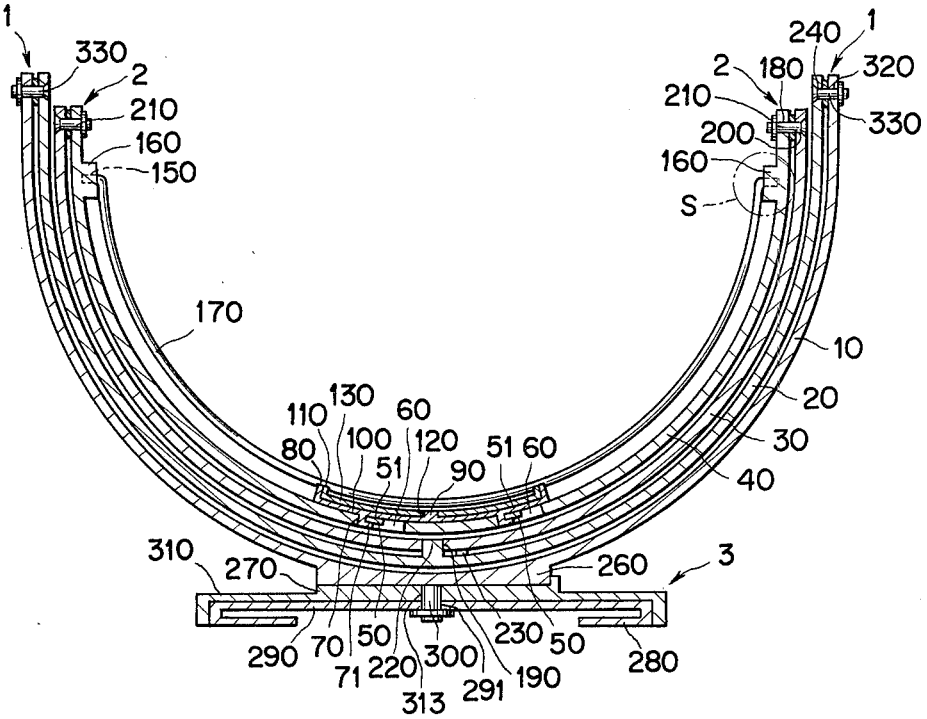
FIG. 3 is a side view of the line III — III in the FIG. 2 showing the condition of combination and of pivot of the elements on the structure.

The each end of the lower base plate 290 is folded back as shown in FIG. 3 and forms hook 280, and a hole 291 corresponding to the center hole of the upper base plate is dug at the center of the lower base plate 290.

The height of the folded back portion of the lower base plate 290 and the height of the inner wall of the bent end of the upper base plate 310 are same so as to keep horizontal or virtical condition.

A pivotal pin 300 is inserted through the lower hole 291 to the upper hole 313 and the foregoing base plate 310 and 290 are rotatably engaged to each other.

When the structure of the present invention is placed on at disposition, the dovetail tenon of the upper base plate 310 is engaged to the dovetail groove of the slinger 10, and then the pedestal 3 is placed on the board or is hung to the hook 321 on the wall 320 after the both base plates 310 and 290 are rotated at right angles. The inner member 2 consisting of the rotator 30 and rocker 40 is rotated at right angles against the outer member 1 consisting of slinger 10 and dangler 20. The rear portion of the bottom of the rotator 30 is engaged between a pair of stopper protrusion 230 projected on the bottom of dangler 20. The upper support 130 is rotated at right angles against the lower support 100. And also two springy protection 170 engaged to the both protrusion 160 of the rocker 40 are outwardly rotated so as to take shape of a ring and are engaged with the transverse groove 151.

On the crossed both lower and upper supports 110 and 130, container, board or dish etc. which should be always kept horizontal posture and condition is placed. The dangler 20 or rocker 40, or the both members move pivotally at the pivoted ends, and restore and keep always the horizontal posture or condition thereof, even if the board or wall which placed the structure rolls, pitches or sways.

Therefore, without regard to any movement of the place on which the slinger 10 is settled, it can be kept the horizontal posture or condition on the rocker 40 by righting moment in accordance with gravity thereof. In the case where the horizontal maintenance structure of the present invention is used for foundation of heavy weight article as a rest room for prevention from seasickness, bench on the ship or carrier, it may be selected suitable means of undercarriage and or spring devices to be settled to the structure of the present invention on which it can always enjoy horizontal posture or condition in spite of the bad weather or inclination.

Since the present invention has the foregoing construction, it can be folded up and stowed when not used, and also it can be possible to carry with in the case where the structure is handy and portable.

Consequently, it can be modified to a handy and light weight small type device for travelling purpose so as to be suitable device on which a container for juicy contents may be placed. On the other hand, it can be modified to a larger type construction having suitable strength in accordance with use for various purpose, in the case where the structure of the present invention is used a base plate for a workplate of galley, a table or bench in the purpose of prevention from seasickness. Particularly, when the structure of the present invention is installed in a cabin, stateroom or other room in ferry boat or passenger boat, excellent effect for prevention from seasickness is certainly obtained.

The invention may be embodied in other specific forms without departing from its spirit or essential characteristics. The described embodiment is to be considered in all respects only as illustrative and not respective and the scope of the invention is, therefore, indicated by the appendant claims rather than by the foregoing description. All changes which come within the meaning and range of equivalency of the claims are to be amended within their scope. Consequently, it is recognized many variation may be made without departing from the scope or spirit of the present invention.

What is claimed is:

1. The horizontal posture maintenance structure comprising: an outer member consists of a slinger and a dangler which curve and are shaped of similar figure and long narrow strip pieces and are pivoted at both ends, and an inner member consists of a rotator and a rocker which curve and are shaped of similar figure long narrow strip pieces by same manner of the foregoing outer member and are pivoted at both ends, and the dangler and the rotator are rotatably engaged at the bottom with each other, and the rocker restores and keeps horizontal posture and condition against inclination when the both outer and inner member are spread to crossed condition.

2. The structure of claim 1, wherein said slinger, dangler, rotator and rocker are generally shaped of semicirculer similar figure and are formed smaller in this order.

3. The structure of claim 1, wherein said slinger, dangler, rotator and rocker are generally shaped of U shape similar figure and are formed smaller in this order.

4. The structure of claim 1, wherein a pair of springy protections are engaged with the both ends of the rocker to spread transverse direction.

5. The structure of claim 1, wherein one or plural supports are rotatably settled on the upper surface of the rocker.

6. The structure of claim 1, wherein pedestal is provided at the rear surface of the bottom of the slinger.

7. The structure of claim 6, wherein the pedestal consists of two upper and lower base plates which are rotatably pinned to spread crossedly, and the both ends of the lower base plate are folded up to form hook portions.

* * * * *